United States Patent [19]

Barton et al.

[11] 4,252,050

[45] Feb. 24, 1981

[54] CONTROL VALVE UNIT FOR HYDRAULIC ACTUATOR

[75] Inventors: James D. Barton, Centerville, Ind.; Charles H. Fox, Greenville, Ohio

[73] Assignee: Ex-Cell-O Corporation, Troy, Mich.

[21] Appl. No.: 14,175

[22] Filed: Feb. 22, 1979

[51] Int. Cl.[3] ..... F15B 13/16

[52] U.S. Cl. ..... 91/358 R; 91/382; 91/387; 91/461

[58] Field of Search ..... 91/382, 358 A, 358 R, 91/385, 386, 387

[56] References Cited

U.S. PATENT DOCUMENTS

| | | | |
|---|---|---|---|
| 1,912,184 | 5/1933 | Ferris et al. | 91/358 R |
| 3,290,996 | 12/1966 | Floyd | 91/387 |
| 3,745,883 | 7/1973 | Ward et al. | 91/386 |
| 3,954,045 | 5/1976 | Barlow | 91/382 |

FOREIGN PATENT DOCUMENTS

| | | | |
|---|---|---|---|
| 956045 | 7/1949 | France | 91/387 |
| 1150452 | 4/1969 | United Kingdom | 91/358 R |

*Primary Examiner*—Paul E. Maslousky

*Attorney, Agent, or Firm*—Reising, Ethington, Barnard, Perry & Brooks

[57] ABSTRACT

A control valve unit (10) disclosed supplies hydraulic fluid to an actuator (12) in a manner that controls both acceleration and deceleration of the actuator movement. A supply valve (14, 22) of the unit is movable from a central closed position in opposite directions to open positions and back to the closed position by a servomechanism (16) and a control circuit (18) that operates the servomechanism to cooperatively control the supply of the hydraulic fluid to the actuator in a manner which controls both acceleration and deceleration of the actuator movement. A control member (62) of the servomechanism operates the supply valve and is moved in a controlled manner by cooperative operation of a pair of hydraulically operated pilot pistons (88*a, b*), a pair of acceleration control pistons (90*a, b*), and a pair of deceleration cams (84*a, b*). Directional and flow control valves (89, 92) of the control circuit operate the pilot pistons and the acceleration control pistons in cooperation with each other. Velocity governors (197) are also provided.

10 Claims, 7 Drawing Figures

CONTROL VALVE UNIT FOR HYDRAULIC ACTUATOR

TECHNICAL FIELD

This invention relates to a control valve unit for controlling the supply of hydraulic fluid to a hydraulic actuator that is alternately movable in opposite directions to provide movement in such directions for whatever purpose is required.

BACKGROUND ART

Hydraulic actuators are utilized in various industrial and other applications to provide movement in opposite directions under the control of hydraulic fluid supplied by a control valve unit. For example, material handling systems, conveyors, indexers, metal removal machines, cold forming machines, feeders, automatic loaders, and door control positioners, etc. utilize hydraulic actuators to control positioning of components during operation. Certain hydraulic actuators are of the rotary type and thus provide rotary movement and positioning, while other hydraulic actuators are of the linear type such as hydraulic cylinders for providing linear movement and positioning.

The U.S. patent of Barlow No. 3,954,045 discloses a control unit for a hydraulic actuator wherein a valve that supplies hydraulic fluid to the actuator is controlled by a solenoid assembly and a cam mechanism in order to control movement of the actuator. Cams of the cam mechanism are contoured to control the opening of the supply valve in cooperation with the solenoid assembly in order to control the actuator movement.

Other hydraulic control valves are disclosed by U.S. Pat. Nos. RE 29,329; 2,879,644; 3,640,069; 3,693,385; 3,779,136; and 3,780,623.

DISCLOSURE OF INVENTION

An object of the present invention is to provide a control valve unit that operates a supply valve for a hydraulic actuator by a servomechanism that terminates the supply of hydraulic fluid to the actuator upon movement thereof to opposite extremes of travel and by a control circuit that operates the servomechanism to control movement of the supply valve from and back to a central closed position in order to cooperatively control acceleration and deceleration of the actuator movement.

Another object of the present invention is to provide a control valve unit for operating a supply valve for a hydraulic actuator by a mechanical servomechanism that terminates the supply of hydraulic fluid to the actuator upon movement thereof to opposite extremes of travel and by a hydraulic control circuit that operates the servomechanism to control movement of the supply valve from and back to a central closed position so as to cooperatively control acceleration and deceleration of the actuator movement.

A further object of the present invention is to provide a control valve unit that operates a supply valve for a hydraulic actuator by a mechanical servomechanism including a control member for moving the supply valve and also having deceleration cams for moving the control member to close the supply valve upon actuator movement to opposite extremes of travel, and wherein the unit also includes a control circuit having a pair of hydraulically actuated pilot pistons that move the control member and having a pair of hydraulic acceleration control pistons that engage the control member to control movement of the supply valve from a central closed position thereof such that the servomechanism and control circuit cooperatively control both acceleration and deceleration of the actuator movement.

In carrying out the above objects and other objects of the invention, the control valve unit preferably includes a directional valve for selectively supplying hydraulic control fluid to one or the other of the pilot pistons in order to initiate movement of the control member that commences opening of the supply valve and accompanying movement of the actuator in an associated direction. A flow control valve of the unit limits the flow of hydraulic control fluid from the acceleration control pistons to govern movement of the control member and thereby control acceleration of the actuator movement. In its preferred construction, the flow control valve is adjustable so that the acceleration can be adjusted. A pair of restricted openings of adjustable size, a pair of check valves associated with the restricted openings, a passage that extends between the directional valve and the check valves, and a pair of passages that respectively extend between the check valves and the associates acceleration control pistons allow these pistons to continue to function even if some small leakage should develop in the unit at such pistons or at the flow control valve.

The pilot pistons of the control valve unit each have an extendable and retractable construction and are biased to their extended positions by associated springs. One piston end of each pilot piston is selectively biased by hydraulic control fluid from the directional valve in order to compress the spring thereof so that another plunger end thereof can act on the control member to provide movement that opens the supply valve in order to commence movement of the hydraulic actuator. The control member is disclosed in the form of a cradle that is slidably mounted on a valve block that receives a spool of the supply valve, the pilot pistons, and the acceleration control pistons. Legs of the cradle are located on opposite sides of the valve block and engaged with opposite ends of the supply valve spool, the plunger ends of the pilot pistons, and the acceleration control pistons. A connecting portion of the cradle extends between the cradle legs and is moved by a rocker that is controlled by deceleration cams on the actuator in order to provide cradle movement that closes the supply valve to decelerate the movement of the actuator at each extreme of its travel.

The control valve unit is usable with both rotary and linear hydraulic actuators. In addition to providing individual adjustability of the acceleration in each direction of travel by virtue of the flow control valve, individual adjustment of the deceleration is also possible in each direction by provision of adjustable deceleration cams which are also equally adaptable for either rotary or linear actuators. Velocity governors that limit the maximum opening of the supply valve are also provided.

The objects, features, and advantages of the present invention are readily apparent from the following description of the best mode for carrying out the invention when taken in connection with the accompanying drawings.

BEST MODE FOR PRACTICING THE INVENTION

Figure 1:
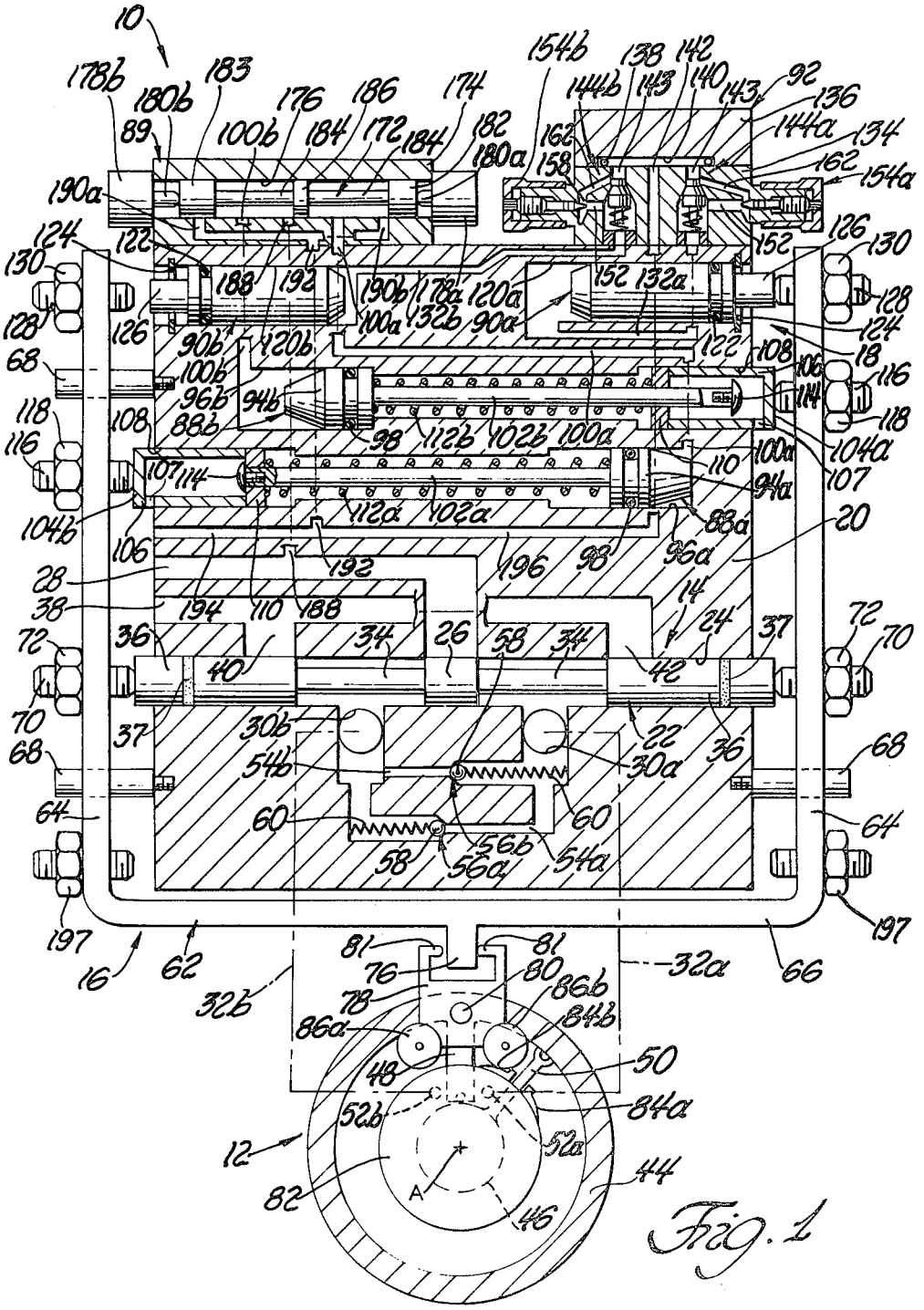
FIG. 1 is a sectional view through a control valve unit constructed in accordance with the present invention and also illustrates a hydraulic actuator of the rotary type which is operated by the control valve unit and shown positioned at its counterclockwise extreme of travel.

Referring to FIG. 1 of the drawings, a control valve unit constructed in accordance with the present invention is indicated generally by reference numeral 10 and operates a hydraulic actuator 12 which is illustrated as being of the rotary type. Control valve unit 10 includes a supply valve 14 that is movable in opposite directions from the central closed position shown so as to supply hydraulic fluid to the actuator 12 in order to selectively actuate movement thereof in either a clockwise or counterclockwise direction. A mechanical servomechanism 16 of the control valve unit operates the supply valve 14 to terminate the supply of hydraulic fluid to the actuator 12 upon actuator movement to its opposite extremes of travel. Control valve unit 10 also includes a hydraulic control circuit indicated collectively by 18 that operates the servomechanism 16 to control movement of the supply valve 14 from and back to the central closed position in order to cooperate therewith in controlling both acceleration and deceleration of the actuator movement.

As seen by continuing reference to FIG. 1, the supply valve 14 and the hydraulic control circuit 18 are housed by a valve block 20 in which fluid passages are provided. A valve spool 22 of supply valve 14 is slidably movable within a bore 24 that extends between the opposite sides of the valve block. Valve spool 22 includes a central land 26 that controls communication between a supply passage 28 and a pair of ports 30*a, b*. Pressurized hydraulic fluid received by the supply passage 28 from a suitable source is fed to the port 30*a* when the valve spool 22 is shifted from its central closed position to an open position to the left and this port then in turn feeds a conduit 32*a* which is connected to the actuator 12 in order to provide clockwise movement as is hereinafter more fully described. Likewise, shifting of the valve spool 22 to an open position to the right feeds the pressurized hydraulic fluid from the supply passage 28 to the port 30*b* so as to be fed therefrom by a conduit 32*b* to the actuator 12 in order to provide counterclockwise rotation. Valve spool 22 includes reduced size connector rods 34 that extend in opposite directions from the central land 26 to end lands 36 which have seals 37 that slidably seal within the opposite ends of the valve bore 24. The reduced size of the connector rods 34 not only allows the flow of the pressurized fluid from the supply passage 28 to the ports 30*a,b* upon valve shifting to the left and the right but also permits fluid to flow back from the actuator through these ports to a return passage 38 during the actuator movement. When the valve spool 22 is shifted to the left in order to feed the port 30*a* which feeds the clockwise conduit 32*a*, fluid from the actuator is fed through the conduit 32*b* back through port 30*b* and around the left connector rod 34 to a downward extension 40 of the return passage 38. Likewise, shifting of the valve spool to the right in order to feed the pressurized hydraulic fluid from the supply passage 28 to the port 30*b* and hence to the counterclockwise conduit 32*b* causes hydraulic fluid to be returned from the actuator through the conduit 32*a* and port 30*a* around the right connector rod 34 to an extension 42 of the return passage 38.

Hydraulic actuator 12 shown in FIG. 1 includes a housing 44 whose illustrated cross section has an annular shape that defines a chamber in which a central shaft 46 is supported for rotation about an axis A. Housing 44 supports a fixed divider 48 that extends downwardly and has a lower seal engaged with the shaft 46 in a slidably sealed relationship. Shaft 46 supports a movable vane 50 whose outer and axial extremes have suitable seals slidably engaged with the housing. Pressurized hydraulic fluid fed through the conduit 32*a* is received through a port 52*a* on the clockwise side of the fixed divider 48 and on the counterclockwise side of the movable vane 50 in order to move the vane in a clockwise direction and thereby actuate clockwise rotation of shaft 46. At the same time, hydraulic fluid located on the counterclockwise side of the fixed divider 54 and on the clockwise side of the movable vane 50 will be forced out of a port 52*b* and back through the conduit 32*b* in the manner previously described. Conversely, pressurized hydraulic fluid fed through the conduit 32*b* through port 52*b* forces the vane 50 in a counterclockwise direction and at the same time forces hydraulic fluid back through the port 52*a* and its associated conduit 32*a*.

Many hydraulic actuators like actuator 12 can be operated by hydraulic fluid being supplied and returned at relatively high but different pressures in both the conduits 32*a* and 32*b*. For example, it might be possible to supply the hydraulic fluid for actuating the movement at a pressure of about 800 psi through the conduit 32*a* while the pressurized fluid within the return conduit 32*b* would be at a lower level of approximately 600 psi. Rotation of the shaft 46 would thus be actuated by the 200 psi differential between the supply and return fluid. However, pressurized hydraulic fluid supplied at a lower level of approximately 500 psi when the pressure of the return fluid is much lower, such as for example on the order of 100 psi, would crease a pressure differential of 400 psi on the opposite sides of the vane 50. This higher pressure differential might cause damage to the seals of the vane 50. As such, the valve block 20 is provided with a pair of parallel passages 54*a* and *b* that extend between the ports 30*a, b* and have associated check valves 56*a, b*. If the pressure in the port 30*a* becomes too much greater than the pressure in the port 30*b*, check valve 56*a* will open in order to limit the pressure differential and thereby prevent possible damage to the hydraulic actuator. Likewise, if the pressure in the port 30*b* becomes too much greater than the pressure in port 30*a*, check valve 56*b* opens to lessen the pressure differential between the ports. Each check valve 56*a, b* includes a suitable valve element such as the balls 58 shown for closing the valve seats of their associated passages. Springs 60 of the check valves have first ends that bias the valve balls 58 to their closed positions and have second ends which are seated by the valve block 20. It should be noted that it is possible to have suitable adjusting screws that seat the second ends of the springs 60 in order to provide adjustment of the pressure differential across the ports 30*a, b* necessary to cause opening of the check valves and a consequent decrease in the pressure differential.

Servomechanism 16 includes a control member preferably in the form of a cradle 62 that has a pair of right and left legs 64 and a connecting portion 66 extending between the legs. Support pins 68 are threaded into the valve block 20 and slidably received by associated openings in the legs 64 in order to support the cradle for movement to the left and the right. A pair of threaded studs 70 are received by threaded holes in the cradle legs 64 and are engaged with the opposite ends of the supply valve spool 22 in order to open and close the supply valve by movement of the cradle to the left and right. Locknuts 72 received by the studs 70 lock the studs against rotation once the supply valve spool 22 has been located in the proper position with respect to the cradle 62.

Figure 3:
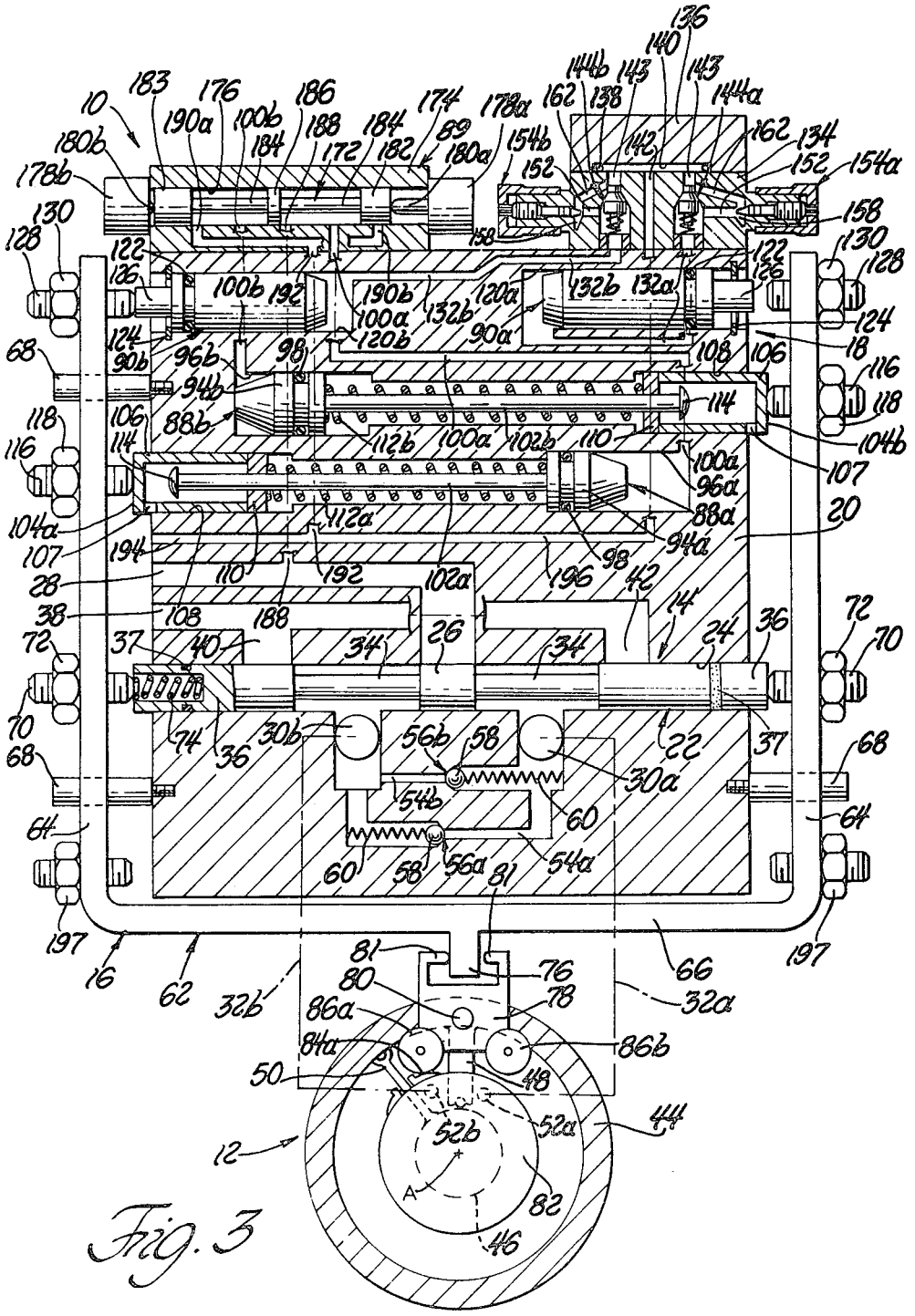
FIG. 3 is a sectional view similar to FIG. 2 showing the control valve unit when the actuator has reached its clockwise extreme of travel.

It will be noted in FIG. 3 that the left stud 70 engages the left end of the supply valve spool 22 through a spring 74 received within an end hole in the spool. Spring 74 allows both ends of the supply valve spool 22 to be engaged by the cradle for positive positioning while accommodating any differential in thermal expansion that may be present as the valve spool and cradle heat up during use of the unit. Since such differential temperature expansion is usually quite small, spring 74 should be relatively stiff and compressed to a large extent in order to insure valve spool movement along with the cradle movement.

Cradle connecting portion 66 has a control lug 76 that is moved by a rocker 78 of the servomechanism to center the cradle so that the supply valve spool 22 is moved to its center closed position shown in FIG. 1 as the shaft 46 of actuator 12 reaches its opposite extremes of travel. Rocker 78 is supported by a pin 80 on the actuator housing 44 and has projections 81 that engage opposite sides of the control lug 76 so as to move the cradle upon pivoting of the rocker. An enlarged diameter end 82 of the actuator shaft 46 supports a pair of deceleration cams 84*a* and 84*b* of the servomechanism. Associated cam followers 86*a, b* on the rocker 78 are engaged by the deceleration cams at the extremes of the clockwise and counterclockwise limits of travel in order to tilt the rocker 78 and thereby center the cradle so that the supply valve 14 is closed by the centering of the valve land 26 which closes off the supply passage 28. Each of the deceleration cams 84*a* and *b* has a contoured surface that controls the rate of deceleration and also has an end lug at the end of its contoured surface so as to provide a final abrupt rotation of the rocker 78 in order to center the cradle and close the supply valve 14 in a manner that accurately locates the position to which the actuator is moved prior to complete closing of the supply valve.

Hydraulic control circuit 18 which operates the servomechanism 16 in cooperation with the deceleration cams 84*a* and *b* includes a pair of pilot pistons 88*a, b* for respectively initiating clockwise and counterclockwise rotation of the actuator 12 upon operation of a directional control valve 89 in a manner which is hereinafter described. Acceleration control pistons 90*a, b* control the acceleration of the actuator movement by controlling the movement of the cradle 62 as the cradle is biased by one of the pilot pistons 88*a* or *b* to open the supply valve 14 in order to feed the pressurized hydraulic fluid from the supply passage 28 through conduit 32*a* or *b* to the actuator. Operation of the acceleration control pistons 90*a, b* is controlled by a flow control valve 92 located on the top of the valve block 20 to the right of the directional valve 89.

Each of the pilot pistons 88*a, b* has a piston end 94*a, b* that is slidable within an associated valve block bore 96*a, b* in a sealed relationship provided by an o-ring seal 98. Passages 100*a, b* communicate the piston bores 96*a, b* with the directional valve 89 to provide hydraulic actuation of the pilot pistons in a manner which is hereinafter described. Connecting rods 102*a, b* of the pilot pistons extend from the piston ends 94*a, b* thereof to plunger ends 104*a, b* of the pilot pistons. Each of the plunger ends 104*a, b* includes a cup-shaped plunger 106 that is slidably received within an associated valve block bore 108 and has a vent opening 107. Each plunger end 104*a, b* also includes an apertured disc 110 that is sealingly slidable within the associated bore 108 and through which the associated connecting rod 102*a, b* extends. Each pilot piston 94*a, b* thus has an extendable and retractable construction. Helical springs 112*a, b* receive the connecting rods 102*a, b* of the pilot pistons and have first ends seated against the piston ends 94*a, b* thereof and second ends seated against the discs 110 of the plunger ends 104*a, b* in order to provide a bias that tends to extend the pilot pistons. Heads of screws 114 threaded into the ends of the connecting rods 102*a, b* engage the plunger discs 110 to limit the degree of extension permitted under the bias of the springs 112*a, b*. The closed ends of the plungers 106 of each pilot piston 88*a, b* are engaged by associated threaded studs 116 that are received by threaded holes in the legs 64 of cradle 62 and secured in adjusted positions by locknuts 118. Hydraulic control fluid which is selectively applied to one or the other of the piston ends 94*a, b* by the directional valve 89 retracts the associated pilot piston 88*a* or *b* against the bias of its associated spring 112*a* or *b* so that the increased force applied by the compressed spring to its associated plunger end 104*a* or *b* acts on the associated cradle leg 64 through the engaged stud 116 to move the cradle to the right or the left in order to open the supply valve 114 and thereby commence clockwise or counterclockwise rotation of the actuator 12.

Acceleration control pistons 90*a, b* are slidably received within associated valve block bores 102*a, b* in a sealed relationship providing by o-ring seals 122. Retaining rings 124 that are snapped into grooves at the outer ends of bores 120*a, b* limit the extent of outward movement of the acceleration control pistons 90*a, b*. Rods 126 of the acceleration control pistons 90*a, b* are engagable with threaded studs 128 that are adjustably positioned within threaded holes in the cradle legs 64 by lock nuts 130 to control the initial cradle movement at the beginning of each cycle so as to thereby control the opening movement of the supply valve 14 and the resultant acceleration of the hydraulic actuator 12. At the inner ends of the acceleration control pistons 90*a, b* the associated valve block bores 120*a, b* are communicated by passages 132*a, b* with the flow control valve 92. Hydraulic control fluid received within one of the bores 120*a* or *b* at the beginning of each cycle is forced through the flow control valve at a controlled rate so as to thereby provide the control of the initial cradle movement and opening of the supply valve 14 as well as the consequent acceleration of the hydraulic actuator movement.

Figure 4:
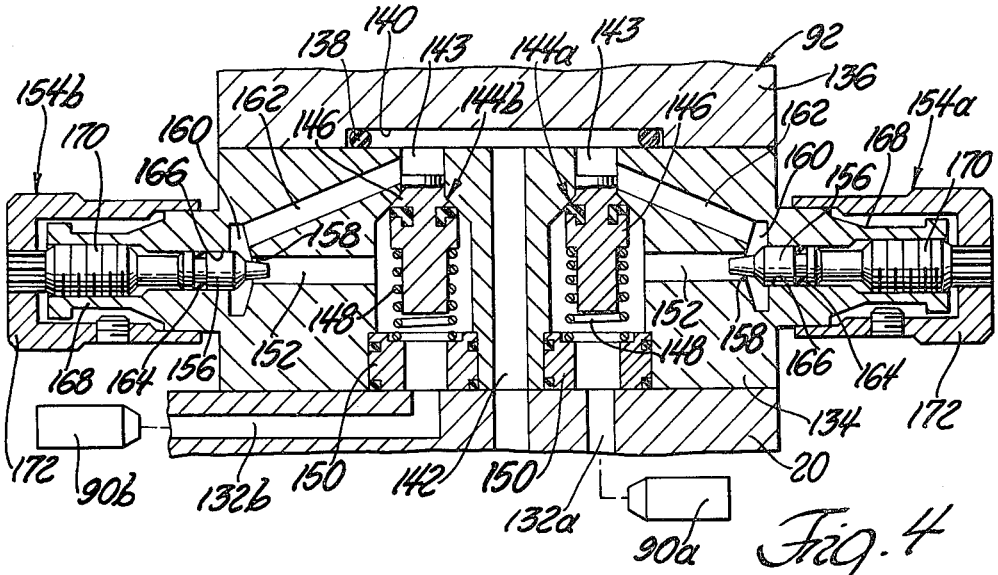
FIG. 4 is an enlarged view of a portion of the control valve unit shown in FIGS. 1 through 3 and illustrates a flow control valve of the unit.

Referring to FIG. 4, flow control valve 92 includes a valve block 134 mounted on top of the block 20 and secured in position in any suitable manner such as by unshown bolts. Likewise, a manifold block 136 is mounted on top of the block 134 and secured in any suitable manner such as unshown bolts with an o-ring seal 138 clamped therebetween so as to seal around a recess 140 that is fed control hydraulic fluid through a passage 142 at the beginning of each movement of the hydraulic actuator as is more fully hereinafter described. Recess 140 is communicated with passages 143 that are communicated with associated check valves 144*a* and 144*b*. Each check valve 144*a, b* has a valve element 146 that is biased upwardly by an associated spring 148 whose lower end is seated by a fitting 150 that communicates with the associated valve block passage 132*a* or *b*.

At the beginning of each actuator cycle, one of the pilot pistons feeds a surge of hydraulic control fluid to the flow control valve 92 shown in FIG. 4 through passage 142 and opens the valve element 146 of one of the check valves 144*a* or *b* so as to feed hydraulic control fluid through one of the passages 132*a* or *b* in order to extend the acceleration control piston 90*a* or *b* which controls the acceleration for the next following cycle of the actuator as is more fully hereinafter described. Hydraulic control fluid from the acceleration control piston 90*a* or *b* that controls the acceleration on the prior cycle now being described in then fed through the associated passage 132*a* or *b* to the lower side of the other check valve 140*a* or *b* by the cradle bias. Of course, this control fluid is not free to flow directly up through the passage 143 due to the closed valve element 146 biased by the associated spring 148 and, as a result, must flow around the check valve through an associated passage 152 to a leakage valve 154*a* or *b*. Each leakage valve 154*a, b* includes a needle valve element 156 that is received within the outer end of the adjacent passage 152 in order to provide a restricted opening 158 of an annular shape. After flowing through the restricted opening 158, the control fluid passes into a chamber 160 that feeds one end of a passage 162 whose other end feeds the associated passage 143 so that the control fluid can then flow through the manifold block recess 140 into passage 142 and to drain as will be described later. Limiting the rate at which the control fluid can flow from each acceleration control piston 90*a* or *b* through its associated restricted opening 158 controls the rate at which the associated pilot piston can move the cradle to open the supply valve to the hydraulic actuator and hence controls the acceleration of the actuator movement. Each of the needle valve elements 156 has an o-ring seal 164 that is sealed within a hole 166 through a valve block extension 168 and also has a threaded portion 170 that is received by an enlarged outer end of the hole 166 in a threaded relationship. A knob 172 is provided to rotate the needle valve element 156 so that threaded support thereof on the extension 168 moves its inner end inwardly and outwardly with respect to the restricted opening 158 in order to control the size of the opening. Such adjustment of the size of opening 158 controls the rate at which leakage flow takes place from the acceleration control pistons 90*a, b* in order to thereby control the acceleration of the hydraulic actuator movement.

As seen by referring back to FIG. 1, the direction control valve 89 includes a control spool 172 and a valve block 174 that is mounted on the valve block 20 in any suitable manner such as by unshown bolts. A bore 176 of valve block 174 slidably receives the control spool 172 for movement to the left and the right under the control of a pair of solenoids 178*a, b*. Plungers 180*a, b* of the solenoids respectively engage right and left end lands 182 and 183 of the control spool 172. Connecting rods 184 extend in opposite directions from a central land 186 to the end lands 182 and 183. Control spool 172 functions to control the flow of pressurized fluid from the supply passage 28 through a passage 188 to either passage 100*a* or passage 100*b* which are respectively associated with the pilot pistons 88*a, b*. Branch passages 190*a, b* open to the bore 176 of valve block 174 adjacent its ends and feed a common passage 192 which is connected to a drain passage 194 and to a connecting drain passage 196 that is communicated with the passage 142 of the flow control valve 92.

OPERATION

Operation of the control valve unit 10 to control movement of the hydraulic actuator 12 during a clockwise cycle of movement from the position of FIG. 1 through the position of FIG. 2 and finally to the position of FIG. 3 will now be described. At the end of a prior counterclockwise cycle of operation, the control valve unit 10 and the hydraulic actuator 12 have their components positioned as shown in FIG. 1. In this condition, the pressurized hydraulic fluid from the supply passage 28 is fed through the passage 188 to the directional control valve 89 between the left end land 183 and the central land 186 of its control spool 172. As such, the control fluid is then fed through the passage 100*b* to the bore 96*b* so as to force the piston end 94*b* of pilot piston 88*b* to the right and thereby compress its spring 112*b* so that this pilot piston is retracted to exert a bias to the right on the leg 64 of cradle 62. This bias to the right is applied by the right plunger end 104*b* of pilot piston 88*b* acting on the threaded stud 116 carried by the right cradle leg 64. Pilot piston 88*a* is then extended so that its spring 112*a* exerts a lesser force on the threaded stud 116 carried by the left cradle leg 64. Deceleration cam 84*b* on the shaft end 82 of the hydraulic actuator 12 exerts an upward force on the cam follower 86*b* so as to bias the rocker 78 counterclockwise about pin 80 such that its right projection 81 acts on the cradle control lug 76 to force the cradle to the left in order to counteract the pilot piston bias of the cradle to the right. Cradle 62 is thus centered so as to position the valve spool 22 of supply valve 14 at its central closed position blocking flow from the main supply passage 28 to either of the ports 30*a, b*. However, it should be noted that hydraulic fluid remains within the housing 44 of the hydraulic actuator 12 within the two chambers cooperatively defined by the fixed divider 48 and the movable vane 50 so as to thereby maintain the actuator shaft 46 in the position shown. Also, it should be noted that the acceleration control piston 90*a* which controls acceleration during a clockwise cycle is extended in the condition shown so that its rod 126 engages the threaded stud 128 on the right cradle leg 64 so as to be capable of limiting the cradle movement to the left in order to thereby limit the rate of opening of the supply valve 14 and the consequent acceleration of the actuator movement.

Figure 2:
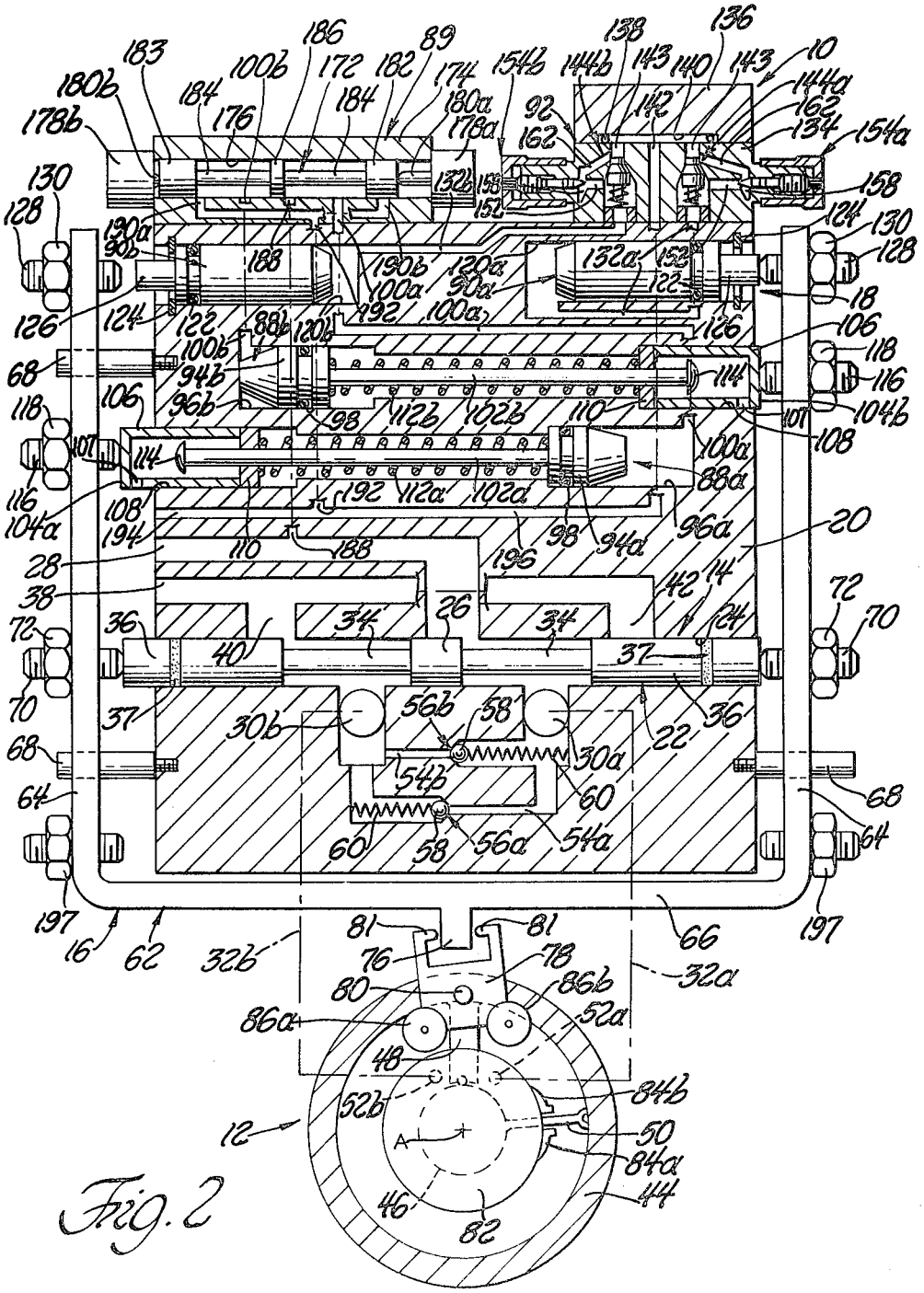
FIG. 2 is a sectional view similar to FIG. 1 illustrating the positioning of the control valve unit components when the actuator is moved clockwise from the counterclockwise extreme of travel.

Commencement of a clockwise cycle of rotation begins by suitable electrical signals which are supplied from a conventional control panel to the solenoids 178*a* and/or *b* in order to retract the solenoid plunger 180*b* and extend the solenoid plunger 180*a* so that the control spool 172 of direction valve 89 shifts from its right position shown in FIG. 1 to its left position shown in FIG. 2. This shifting of the directional control valve spool 172 initiates two operations which occur substantially simultaneously. First, the pressurized hydraulic fluid from supply passage 28 through the passage 188 to the directional control valve 89 is cut off from the passage 100*b* through which hydraulic pressure is maintained within the piston end bore of pilot piston 88*b* in order to maintain this pilot piston retracted so that the control cradle 62 is biased toward the right. Communication of the passage 100*b* with the branch passage 190*a* then communicates the pressurized hydraulic fluid in the bore 96*b* of pilot piston 88*b* with the passage 192 that connects to the drain passage 194. As such, the compressed spring 112*b* of pilot piston 88*b* is allowed to extend and such extension moves the associated piston end 94*b* from the right as shown in FIG. 1 to the left as shown in FIG. 2 with an accompanying surge of hydraulic control fluid through the passage 192 to the drain passage 194. Approximately half of this surge of hydraulic control fluid passes through the drain passage 194 while the other half flows through the connecting passage 196 to the passage 142 of the flow control valve 92. This flow of hydraulic control fluid to the control valve 92 then unseats the check valve 144*b* to feed fluid through the passage 132*b* and thereby move the acceleration control piston 90*b* from the right as shown in FIG. 1 to the left as shown in FIG. 2 in preparation for the next following cycle. In this regard it should be noted that the drain passage 194 is separate from the return passage 38. If such passages were connected to a common dump, the return pressure might become great enough to flow through passage 196 and open the check valves 144*a, b* of the flow control valve 92 at an improper time.

As the control spool 172 of the directional valve 89 is shifted from the right position shown in FIG. 1 to the left position shown in FIG. 2 to cut off the supply of pressurized hydraulic fluid to the pilot piston 88*b* as described above, the supply of pressurized hydraulic fluid flow from passage 188 is communicated between the right land 182 and the central land 186 of the directional control valve spool with the passage 100*a* that communicates with the bore 96*a* in which the piston end 94*a* of pilot piston 88*a* is located. As such, bore 96*a* is fed pressurized hydraulic fluid to move piston end 94*a* from the right as shown in FIG. 1 to the left as shown in FIG. 2. This shifting causes a retraction of the pilot piston 88*a* as its piston end 94*a* moves to the left with respect to its plunger end 104*a* and as the connecting rod 102*a* slides through the apertured plunger disc 110. Consequent compression of the spring 112*a* of the pilot piston 88*a* then exerts a bias through its plunger end 104*a* so as to act on the threaded stud 116 carried by the left leg 64 of cradle 62 in order to bias the cradle 62 toward the left. Movement of the cradle 62 toward the left is then resisted by the acceleration control piston 90*a* in order to limit the rate at which the supply valve 14 is opened and to thereby control the acceleration of the movement of hydraulic actuator 12 in the clockwise direction. Hydraulic fluid within the bore 120*a* to the left of acceleration control piston 90*a* is forced through the passage 132*a* by the leftward bias of the cradle 62 and is fed to the leakage valve 154*a* for flow through the restricted opening 158 that governs the actuator acceleration. After flowing through the restricted opening 158 in the manner previously described, this hydraulic control fluid is forced through the passages 162 and 143 that feed the recess 140 and the passage 142 for flow through the connecting passage 196 to the drain passage 194. Cradle movement to the left is thus controlled by the acceleration control piston 90*a* to limit the leftward movement of the spool 22 of the supply valve 14 in order to limit the flow of hydraulic fluid to the port 30*a* that feeds the conduit 32*a* for actuating clockwise rotation of the actuator shaft 46 in the manner previously described. Cradle 62 will continue to move slowly toward the left until the supply valve 14 is fully opened or until deceleration at the end of the cycle begins.

Clockwise rotation of the hydraulic actuator 12 proceeds generally as shown in FIG. 2 until the deceleration cam 84*a* engages the rocker cam follower 86*a* as shown in FIG. 3. Engagement of the deceleration cam 84*a* with the cam follower 86*a* exerts a clockwise bias on rocker 78 about its support pin 80 so that the rocker urges the control lug 76 of the cradle 62 toward the right against the leftward bias applied by the pilot piston 88*a*. Cradle 62 is thus moved to the right by the action of the deceleration cam 84*a* acting on the rocker 78 through the follower 86*a* so as to begin closing of the supply valve 14 that feeds the pressurized hydraulic fluid from the supply passage 28 to the hydraulic actuator. Clockwise rotation of the shaft 46 of the actuator is thus decelerated by the operation of the servomechanism 16 through its deceleration cam action. Engagement of the radially projecting lug on the counterclockwise end of the deceleration cam 84*a* provides a final upward movement of the cam follower 86*a* that rotates the rocker 78 clockwise about its support pin 80 to move the cradle 62 to its center position in a manner that accurately locates the final rotational position of the actuator shaft 46 as the supply valve 14 is closed by moving its spool 22 to the central closed position where the land 26 closes the supply passage 28 and where the end lands 36 close the extensions 40 and 42 of the return passage 38. As the cradle 62 is centered, the threaded stud 128 on the right cradle leg 64 disengages the rod 126 of acceleration control piston 90*a* which remains depressed within the valve block bore 120*a*.

A counterclockwise cycle of the actuator 12 for movement from the clockwise position of FIG. 3 back to the counterclockwise position of FIG. 1 is actuated by the control valve unit 10 by moving the control spool 172 of the directional valve 89 to the right by the operation of solenoids 178*a* and/or *b*. Counterclockwise operation then takes place in the same manner previously described with the clockwise cycle but with the pilot piston 88*b* and its associated acceleration control piston 90*b* operating to control the movement of cradle 62 to the right for opening of the supply valve 14 that feeds through the port 30*b* into conduit 32*b* in order to actuate the counterclockwise movement. Likewise, the acceleration control piston 90*b* is controlled by the leakage valve 154*b* and the closing of the supply valve 14 at the end of the cycle is initiated by the deceleration cam 84*b*.

As seen in FIGS. 1, 2, and 3, the cradle 62 has velocity governors embodied by adjustable screw and locknuts collectively indicated by 197. Threading adjustment of the governors 197 limits the cradle movement to the left and the right by engagement with the opposite sides of the valve block 20 in order to control the maximum degree to which supply valve 14 opens. Such operation thus limits the corresponding maximum actuator velocity that can be attained. The maximum velocity in each direction is adjustable independently of the maximum velocity in the other direction to suit any particular application of the actuator.

Figure 5:
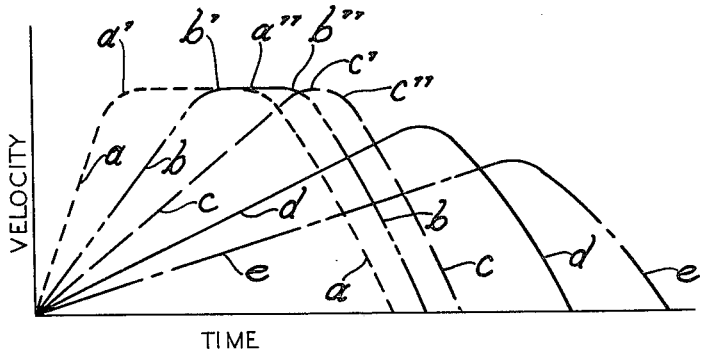
FIG. 5 is a graph which illustrates different velocity and time curves of the actuator movement under the operation of the control valve unit.

Referring to FIG. 5, velocity and time curves a, b, c, d, and e illustrate the manner in which the hydraulic actuator 12 shown in FIG. 1 is moved under the acceleration and deceleration control provided by the control valve unit 10. Curve a illustrates a cycle of movement wherein the leakage valve 154*a* or *b* involved is opened to a greater extent than for the other curves so that the rate of change of the velocity, i.e. the acceleration, is greatest for this curve. The control cradle movement that opens the supply valve to increase the velocity continues as the cycle approaches the point a′ where full opening has taken place and maximum velocity reached. Movement of the actuator at maximum velocity thus proceeds until the deceleration cam begins to operate the servomechanism at point a″ whereupon the velocity decreases as the supply valve is closed. Curves b, d, c, and e illustrate cycles where the restricted opening of the associated leakage valve 154*a* or *b* are progressively smaller in size. Thus, actuator movement during the cycle of curve b reaches the maximum velocity at point b′ after a longer time period than required to reach maximum velocity along curve a. As such, the initial operation of the deceleration cam along curve b does not begin at point b″ until sometime after the time period required for commencement of the deceleration along curve a at point a″; in other words, the slower acceleration of curve b results in a longer cycle. Similarly, maximum velocity along curve c is reached at point c′ just before the deceleration cam operation begins at point c″. Curve c thus has a greater time period for its cycle than curve b. Curves d and e illustrate conditions where the acceleration permitted is limited to such an extent that the supply valve never fully opens before the operation of the deceleration cam begins to close the main supply valve and thereby decelerate the actuator movement.

Referring to FIG. 4 which shows the flow control valve 92 while keeping in mind the previous discussion in connection with FIG. 5, provision of the two leakage valves 154*a* and 154*b* permits different cycles of operation to be programmed during the opposite directions of movement of the hydraulic actuator being operated. For example, if the clockwise stroke whose acceleration is limited by the acceleration control piston 90*a* were to drive a foundry ladle full of molten iron, it may be necessary to have a slower rate of acceleration than would be necessary for the return stroke with an empty ladle when the acceleration control piston 90*b* is limiting the acceleration. In such a case, the leakage valve 154*a* would be adjusted so that its restricted opening 158 is of a much smaller size than the restricted opening 158 of the leakage valve 154*b*. A faster period of operation would thus be possible with the valves 154*a* and 154*b* adjusted in this manner than could be achieved if only a single restricted opening were used.

Another important consideration that should be mentioned in connection with the flow control valve 92 shown in FIG. 4 involves the manner in which the acceleration control pistons 90*a* and *b* are alternately supplied hydraulic fluid to provide the extension that engages these pistons with the cradle on the cycle preceding operation of each of these pistons. It would be possible to have the acceleration control pistons 92*a* and *b* operating through a closed system without the passage circuitry necessary to provide the alternate piston extension previously discussed. However, if one of the seals 122 on one of the pistons 90*a* or *b* were to allow a slight amount of leakage, even if such leakage were to occur over a large number of cycles, operation of the acceleration control would then cease with such a system. However, with the valve control unit herein disclosed, the filling of each piston bore 120*a, b,* with hydraulic control fluid on the cycle preceding its operation prevents such termination of the acceleration control operation if there is a slight amount of leakage at one or both of the seals 122.

Figure 6:
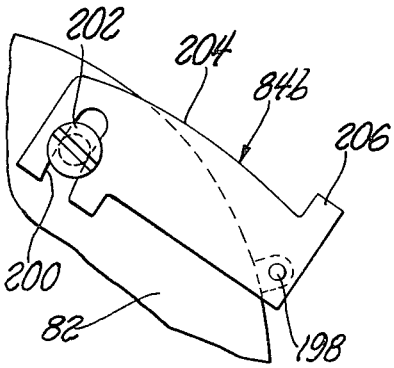
FIG. 6 is a partial view which illustrates an adjustable version of deceleration cams of the control valve unit.

Referring to FIG. 6, an adjustable version of the deceleration cams is illustrated by the deceleration cam 84*b* shown. The deceleration cam 84*a* would likewise have the same construction except for being oriented in the opposite direction. Deceleration cam 84*b* is pivotally supported by a pin 198 on the shaft end 82 of the hydraulic actuator and has an arcuate slot 200 that receives a screw 202 threaded into the shaft end. Pivoting of the deceleration cam 84*b* about the pin 198 with the screw 202 loosened and then tightening of the screw at an adjusted position controls the angle of the contoured cam surface 204 with respect to the axis of rotation of the shaft end so as to thereby control the rate at which the deceleration cam pivots the follower 78 shown in FIG. 1 to move the cradle 62 for closing of the supply valve 14. A faster closing will thus take place before the cam follower reaches the end lug 206 of the deceleration cam when the cam is positioned counterclockwise from the position shown, i.e. the screw 202 being received farther within the slot 200 closer to the closed end of this slot.

It should also be appreciated that just as the velocity and acceleration during each direction of movement is individually adjustable, individual adjustment of the deceleration cams of the type shown in FIG. 6 will likewise permit different rates of deceleration during the opposite directions of actuator movement. It should be noted that the adjustment of the cam 84*b* moves the lug 206 inwardly and outwardly a slight amount with respect to the axis of shaft end rotation and thereby changes the position at which the rocker follower 86*b* engages the deceleration cam surface 204 upon engaging the end lug 206 to terminate movement. To ensure engagement of the rocker follower with both the surface 204 and end lug 206 after cam adjustment, it is desirable to provide the projections 81 of the rocker 78 with the type of threaded stud and locknut construction used on the cradle legs 64 to control the supply valve 14, the pilot pistons 88*a, b* and the acceleration control pistons 90*a, b.* Such threaded stud and locknut constructions permit the cradle position to be adjusted so as to accommodate for the small change in radial position as the cam 84*b* shown in FIG. 6 is adjusted to control the rate of deceleration. Also, each deceleration cam 84*a* and *b* can be mounted on a separate shaft end 82 that is rotatably adjustable with respect to the shaft independently of the other shaft end and its deceleration cam. Such structure allows the limits of movement to be adjusted for the particular application to which the actuator is being adapted.

Figure 7:
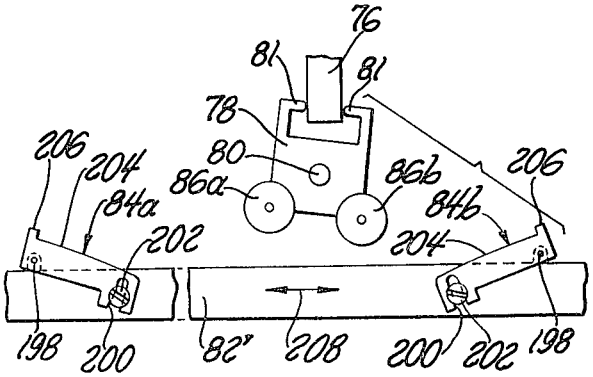
FIG. 7 is a partial view which illustrates the manner in which the control valve unit can be utilized with a linear hydraulic actuator as well as with one of the rotary type.

FIG. 7 is a partial view which shows both adjustable deceleration cams 84*a, b* utilized with a linear actuator whose output member 82' is driven in the direction shown by arrow 208 to provide linear actuation. Thus, a piston or cylinder whose linear actuation is to be controlled is equally usable with the control valve unit 10 that has been previously described in connection with the rotary actuator. Adjustable mounting of the deceleration cams 84*a* and *b* on the linear output member 82' toward and away from each other is also possible to control the limits of movement.

While the best mode for practicing the present invention has herein been described in detail, those familiar with the art to which this invention relates will recognize various alternative designs and embodiments for practicing the present invention as defined by the following claims.

What is claimed is:

1. A control valve unit for a hydraulic actuator, the unit comprising: a supply valve that is movable from a central closed position in opposite directions to open positions so as to supply hydraulic fluid to the actuator in order to selectively actuate movement thereof in opposite directions; a mechanical servomechanism including a control member and a pair of deceleration cams for moving the supply valve to its central closed position so as to terminate the supply of hydraulic fluid to the actuator upon movement thereof to opposite extremes of travel; and a hydraulic control circuit including a pair of pilot pistons that are alternately supplied hydraulic control fluid to move the control member and hence move the supply valve in one direction or the other to one of its open positions in order to commence movement of the actuator in an associated direction, and the control circuit also including a pair of acceleration control pistons that engage the control member to control the opening movement of the supply valve by the pilot pistons, whereby the servomechanism and control circuit cooperatively control acceleration and deceleration of the actuator movement.

2. A unit as in claim 1 further including at least one restricted opening for limiting hydraulic fluid flow in order to limit movement of the acceleration control pistons.

3. A unit as in claim 2 wherein the restricted opening has an adjustable size to thereby permit adjustment of the level of actuator movement acceleration.

4. A unit as in claim 1 wherein the control circuit further includes:

a directional valve for selectively supplying hydraulic control fluid to one or the other pilot pistons in order to move the control member and thereby commence opening of the supply valve and accompanying movement of the actuator in an associated direction; and a flow control valve that limits hydraulic control fluid flow from the acceleration control pistons to govern movement of the control member and thereby control acceleration of the actuator movement.

5. A unit as in claim 4 wherein the flow control valve includes a pair of restricted openings of adjustable size through which hydraulic fluid from the acceleration control pistons is forced to control the actuator movement acceleration.

6. A unit as in claim 5 wherein the flow control valve includes check valves respectively associated with the restricted openings, a passage that extends between the directional valve and the check valves, and a pair of passages respectively extending between the check valves and the acceleration control pistons.

7. A unit as in claim 1 wherein each pilot piston includes first and second ends that are movable with respect to each other in an extendable and retractable manner, and each piston also including a spring that biases the ends thereof in an extending direction.

8. A control valve unit for a hydraulic actuator, the unit comprising: a supply valve that is movable from a central closed position in opposite directions to open positions so as to supply hydraulic fluid to the actuator in order to selectively actuate movement thereof in opposite directions; a mechanical servomechanism including a control member and a pair of deceleration cams for moving the supply valve to its central closed position so as to terminate the supply of hydraulic fluid to the actuator upon movement thereof to opposite extremes of travel; and a hydraulic control circuit including a pair of pilot pistons that are alternately supplied hydraulic control fluid to move the control member and hence move the supply valve in one direction or the other to one of its open positions in order to commence movement of the actuator in an associated direction, each of said pilot pistons including a piston end and a plunger end slidably supported in an extendable and retractable relationship with respect to each other, each pilot piston also including a spring that biases the piston and plunger ends thereof away from each other so as to provide a bias that engages its plunger end with its control member, the control circuit also including a pair of acceleration control pistons that engage the control member to limit the control member movement that opens the supply valve under the impetus of the pilot pistons, and the control circuit also including a directional valve for operating the pilot pistons and a flow control valve for operating the acceleration control pistons, whereby the servomechanism and control circuit cooperatively control acceleration and deceleration of the actuator movement.

9. A control valve unit for a hydraulic actuator, the unit comprising: a supply valve that is movable from a central closed position in opposite directions to open positions so as to supply hydraulic fluid to the actuator in order to selectively actuate movement thereof in opposite directions; a mechanical servomechanism including a control member and a pair of deceleration cams for moving the supply valve to its central closed position so as to terminate the supply of hydraulic fluid to the actuator upon movement thereof to opposite extremes of travel; and a hydraulic control circuit including a pair of pilot pistons that are alternately supplied hydraulic control fluid to move the control member and hence move the supply valve in one direction or the other to one of its open positions in order to commence movement of the actuator in an associated direction, each of said pilot pistons including a piston end and a plunger end slidably supported in an extendable and retractable relationship with respect to each other, each pilot piston also including a spring that biases the piston and plunger ends thereof away from each other so as to provide a bias that engages its plunger end with the control member, the control circuit also including a pair of acceleration control pistons that engage the control member to limit the control member movement that opens the supply valve under the impetus of the pilot pistons, a directional valve for selectively supplying pressurized hydraulic fluid to either pilot piston in order to retract the ends thereof relative to each other in order to compress its spring and thereby move the control member to one of the open positions against the bias of the other pilot piston, and a flow control valve having a pair of restricted openings of adjustable size through which the acceleration control pistons respectively force hydraulic fluid to limit the control member movement under the impetus of the pilot pistons, whereby the servomechanism and control circuit cooperatively control acceleration and deceleration of the actuator movement.

10. A control valve unit for a hydraulic actuator, the unit comprising: a valve block; a supply valve having a spool that is movable within the valve block from a central closed position in opposite directions to open positions so as to supply hydraulic fluid to the actuator in order to selectively actuate movement thereof in opposite directions; a mechanical servomechanism including a pair of deceleration cams, a rocker moved by the deceleration cams at opposite extremes of the actuator travel, and a cradle mounted on the valve block and moved by the rocker so as to move the spool of the supply valve to the central closed position thereof in order to terminate the supply of hydraulic fluid to the actuator; and a hydraulic control circuit including a pair of pilot pistons that are alternately supplied hydraulic control fluid to move the cradle and hence move the supply valve spool in one direction or the other to one of its open positions in order to commence movement of the actuator in an associated direction, each of said pilot pistons including a piston end and a plunger end slidably supported in an extendable and retractable relationship with respect to each other, each pilot piston also including a spring that biases the piston and plunger ends thereof away from each other so as to provide a bias that engages its plunger end with the cradle, the control circuit also including a pair of acceleration control pistons that engage the cradle to limit the cradle movement that opens the supply valve spool under the impetus of the pilot pistons, a directional valve for selectively supplying pressurized hydraulic fluid to either pilot piston in order to retract the ends thereof relative to each other in order to compress its spring and thereby move the cradle to one of the open positions against the bias of the other pilot piston, and a flow control valve having a pair of restricted openings of adjustable size through which the acceleration control pistons respectively force hydraulic fluid to limit the cradle movement under the impetus of the pilot pistons, each restricted opening of the flow control valve having an associated check valve, and passages in the valve block that communicate the piston ends of the pilot pistons with the check valves such that extension of the pilot pistons supplies hydraulic fluid through the associated check valve to the associated acceleration control valve to provide engagement thereof with the cradle, whereby the servomechanism and control circuit cooperatively control acceleration and deceleration of the actuator movement.

* * * * *

UNITED STATES PATENT AND TRADEMARK OFFICE

CERTIFICATE OF CORRECTION

PATENT NO. : 4,252,050

DATED : February 24, 1981

INVENTOR(S) : James D. Barton et al

It is certified that error appears in the above—identified patent and that said Letters Patent is hereby corrected as shown below:

Column 6, line 61
"102a" should be --120a--.

Column 6, line 62
"providing" should be --provided--.

Column 7, line 43
"in" should be --is--.

Column 9, line 16
"direction" should be --directional--.

Claim 8, line 38
second instance should be --the--.

Signed and Sealed this

Thirtieth Day of June 1981

[SEAL]

Attest:

RENE D. TEGTMEYER

Attesting Officer

Acting Commissioner of Patents and Trademarks

UNITED STATES PATENT AND TRADEMARK OFFICE

CERTIFICATE OF CORRECTION

PATENT NO. : 4,252,050

DATED : February 24, 1981

INVENTOR(S) : James D. Barton et al.

It is certified that error appears in the above—identified patent and that said Letters Patent is hereby corrected as shown below:

Column 6, line 61, "102a" should read -- 120a --.

Column 6, line 62, "providing" should read -- provided --.

Column 7, line 43, "in" should read -- is --.

Column 9, line 16, "direction" should read -- directional --.

Claim 8, line 38, "its" (second instance) should read -- the --.

This certificate supersedes Certificate of Correction issued June 30, 1981

Signed and Sealed this

*Eighth* Day of *September 1981*

[SEAL]

*Attest:*

GERALD J. MOSSINGHOFF

*Attesting Officer*

*Commissioner of Patents and Trademarks*